US007581416B1

(12) United States Patent
Lenertz

(10) Patent No.: US 7,581,416 B1
(45) Date of Patent: Sep. 1, 2009

(54) PRISONER TRANSPORT SYSTEM

(76) Inventor: John Lenertz, P.O. Box 701, Brainerd, MN (US) 56401

( * ) Notice: Subject to any disclaimer, the term of this patent is extended or adjusted under 35 U.S.C. 154(b) by 150 days.

(21) Appl. No.: 11/803,453

(22) Filed: May 15, 2007

Related U.S. Application Data

(60) Provisional application No. 60/801,295, filed on May 18, 2006.

(51) Int. Cl.
*E05B 75/00* (2006.01)

(52) U.S. Cl. ..... 70/16; 128/869; 119/770

(58) Field of Classification Search ..... 70/16; 128/869.876, 878, 879; 119/856, 857, 770
See application file for complete search history.

(56) References Cited

U.S. PATENT DOCUMENTS

| | | | | |
|---|---|---|---|---|
| 274,752 | A | 3/1883 | Foley | |
| 974,857 | A | 11/1910 | Brock | |
| 1,310,958 | A | 7/1919 | O'Connor | |
| 2,324,183 | A | 7/1943 | Wilson | |
| 2,430,996 | A | 11/1947 | Taylor | 29/84 |
| 3,616,665 | A | 11/1971 | Rosenthal | 70/16 |
| 3,740,977 | A | 6/1973 | Stefansen et al. | 70/16 |
| 3,972,093 | A | 8/1976 | Aimar | 24/90 |
| 4,860,560 | A | 8/1989 | Lundelius | 70/16 |
| 4,949,679 | A | 8/1990 | Wolfer | 119/96 |
| 4,993,215 | A * | 2/1991 | Schutte | 54/19.3 |
| 5,031,639 | A | 7/1991 | Wolfer | 128/874 |
| 5,345,947 | A * | 9/1994 | Fisher | 128/878 |
| 5,388,551 | A * | 2/1995 | Martusciello | 119/770 |
| 5,469,813 | A * | 11/1995 | Peden | 119/770 |
| 5,542,433 | A * | 8/1996 | Saupe | 128/869 |
| 5,551,447 | A * | 9/1996 | Hoffman et al. | 128/869 |
| 5,732,576 | A | 3/1998 | Moore et al. | 70/16 |
| 5,829,443 | A | 11/1998 | Cunningham | 128/869 |
| 6,000,249 | A | 12/1999 | Wilber | 70/16 |
| 6,360,747 | B1 * | 3/2002 | Velarde et al. | 128/869 |
| 2004/0025804 | A1 * | 2/2004 | Smith et al. | 119/792 |
| 2005/0229867 | A1 * | 10/2005 | Green | 119/770 |
| 2007/0006823 | A1 * | 1/2007 | Sandberg | 119/856 |

* cited by examiner

*Primary Examiner*—Suzanne D Brainerd
(74) *Attorney, Agent, or Firm*—Westman, Champlin & Kelly, P.A.

(57) ABSTRACT

A restraint strap system for a prisoner or other person to be transported comprises an elongated strap with a neck loop, and a front section that overlies the front of a person when installed or worn, and which is of length so that it passes between the legs of the wearer. A back flexible member, such as a strap or chain is attached to the lower portion of the front section and passes to the back of the wearer. The back flexible member is secured to a connector at the back of the neck loop with a quick attachment link and a lock. The front strap includes provisions for passing a body band through a formed loop in the front section and which body band is secured at the rear with the lock system for the back flexible member. An elongated link that can be locked in place after securing handcuffs, a belly chain, or a body belt in place at the front of the wearer is provided.

11 Claims, 9 Drawing Sheets

PRISONER TRANSPORT SYSTEM

This application refers to and claims priority on U.S. Provisional Application Ser. No. 60/801,295, filed May 18, 2006, the content of which is incorporated by reference.

BACKGROUND

The present disclosure relates to security restraining-type belt or strap systems to insure security when transporting prisoners or others to be restrained from one location to another by any selected method such as in a vehicle or by air, and designed to reduce the possibility of escape.

A common type of transport belt has a ring onto which handcuffs, a belly chain or a "gang chain" can be held with a lock. One can utilize what is called a "blue box" which is a housing that will go between the wrist encircling portion of the handcuffs and then a belly chain can be used hold the handcuff box in place for securing the cuffs. When the prisoner is placed into the cuffs, and the box is secured to the belly chain, little movement is permitted. Additionally, chains can be used on the legs, and a connector chain from the leg chains can be secured with a padlock back to the ring that supports the handcuffs on the transport belt. The existing transport belts are leather and are hard to sterilize after use.

SUMMARY OF THE DISCLOSURE

The present device discloses offers improvements in a restraint harness or strap that is placed on a prisoner or other person and which has improved attachments for handcuffs and body bands or to the strap. The restraint strap is not easily destroyed, can be sanitized, and is made so that the stitching that is used for stitching in rings and forming loops is protected against ripping. The strap in one form of the disclosure has a length adjustment that is easy to use so that the amount of slack that is available to the prisoner when the prisoner sits down is minimized. A second form of restraining strap has a back chain that can be adjusted to a selected length. The front of a vertically extending (head to crotch) restraint strap or belt has an elongated link that has its length in vertical direction, with one end permanently attached to a top ring sewn into the strap and which is long enough to permit handcuffs or belly chains to be secured and this link also will receive a "D" ring from a conventional transport belt. The link has a free end that can be inserted through a second sewn in ring and secured with a padlock. The handcuffs also can be held with a padlock to the link.

One embodiment includes an accessory quick attach latch link which again is an elongated or race tracked shaped enclosed link, and which has a permanently attached annular stop ring looped into it. The quick attach auxiliary link is used for securing body bands, belts or chains to a back strap or back chain member chain in one form of the disclosure. The quick attach latch link permits one to add additional restraint devices, such as leg irons or a gang chain to the restraint. The quick attach latch link will permit attaching a belly chain of various kinds, as well as a chain for joining a plurality of prisoners together without permitting one prisoner to work on release of another to attempt to escape.

DETAILED DESCRIPTION OF EXEMPLARY EMBODIMENTS

Figure 1:
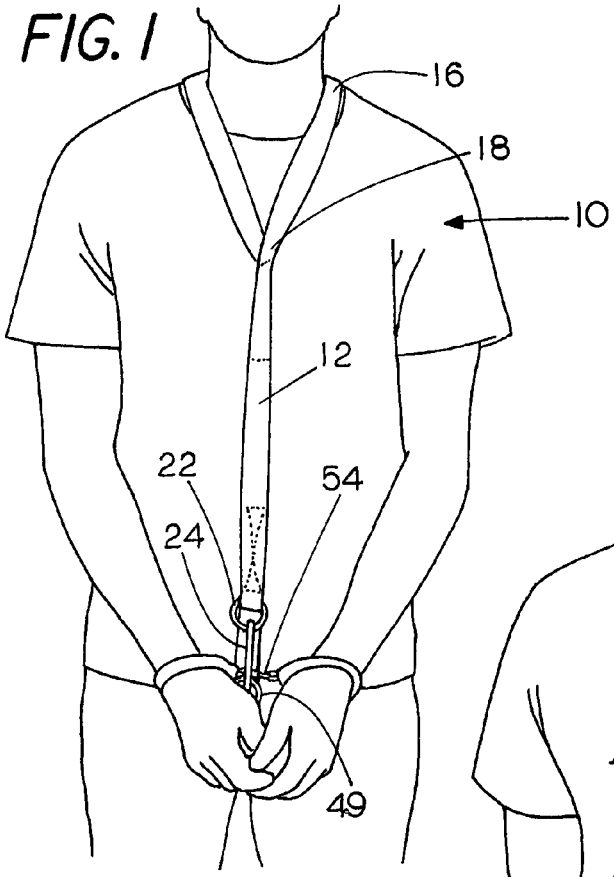
FIG. 1 is a front view of a person having the prisoner restraint strap made according to one form of the present disclosure installed, and showing handcuffs in place on the wrists of the wearer.
Figure 4:
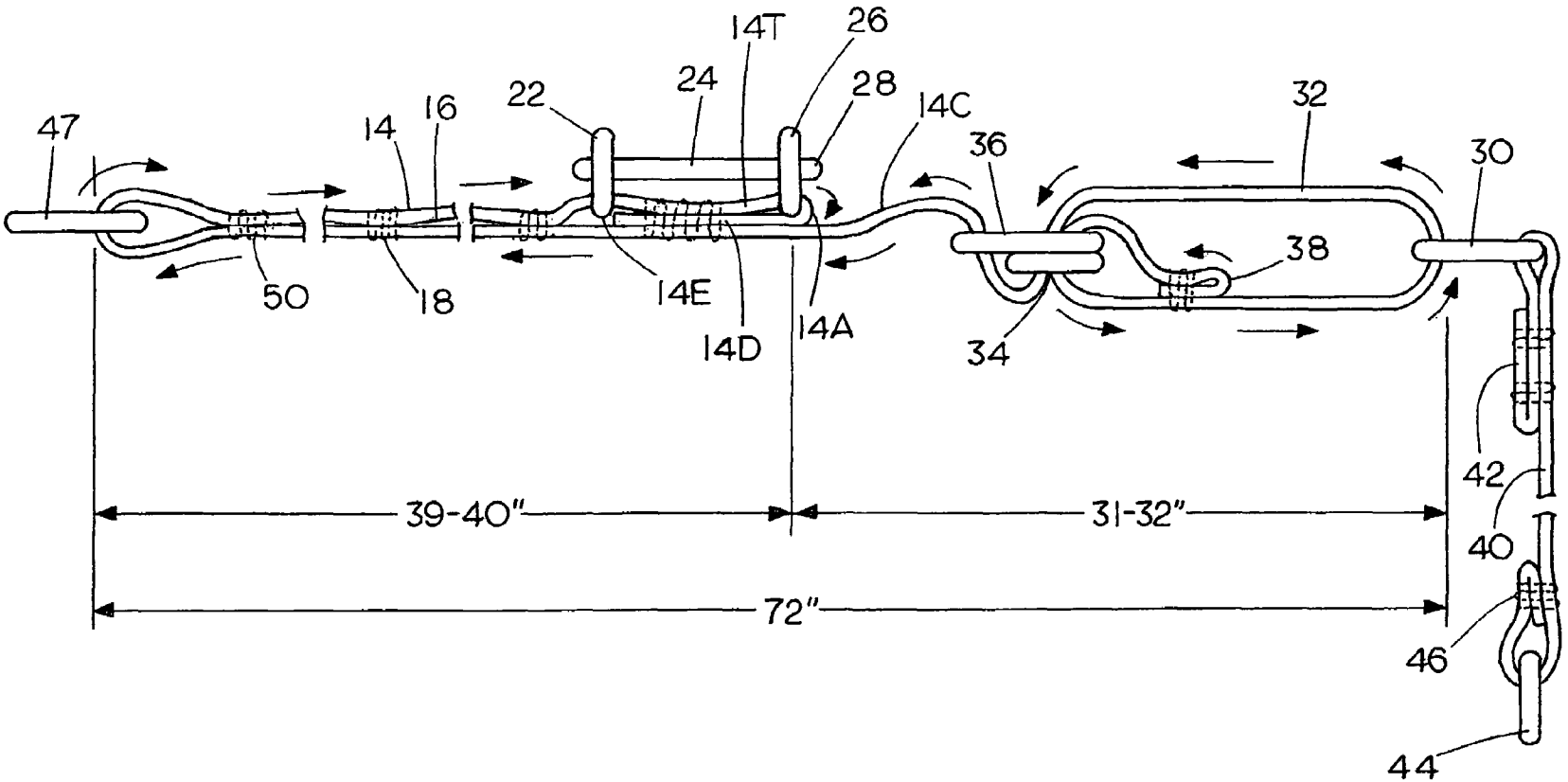
FIG. 4 is a side schematic layout of the prisoner restraint strap system of one form of the present disclosure illustrating various features.

Referring to FIG. 1, a prisoner represented at 10 as shown in the restraint strap system or assembly 12 of one form of the present disclosure, that comprises an elongated strap 14 that is approximately 1 inch wide and is made of suitable strong fabric type material, in one embodiment, of nylon, so that it can be sterilized, and does not stretch substantially, and also so it can be sewn. The strap 14 has a neck loop 16 of size to go over the head and that extends around the neck of the prisoner 10. Two layers of the strap overlie each other and are sewn in desired locations so the strap 14 is a single width, and double strength. The junction 18 forming the neck loop 16 is sewn. The main chest or frontal portion 12 of the restraint strap assembly is from a continuous strap, as shown in FIG. 4, that is looped at the back of the neck and is sewn together in the region 48 (FIG. 2), with strong, and rip resistant stitching. The rings and link are sewn in as well.

Approximately 17 inches or so down from the junction 18 a retainer ring 22 is placed between two layers or lengths of strap with a strap end portion 14D having an end section 14E between the layers or lengths of strap and adjacent the ring 22. The strap layers are stitched or sewn on opposite sides of the ring 22. The retainer ring 22 is approximately 1¼ inches in diameter, or it can be a "D" ring.

Figure 5:
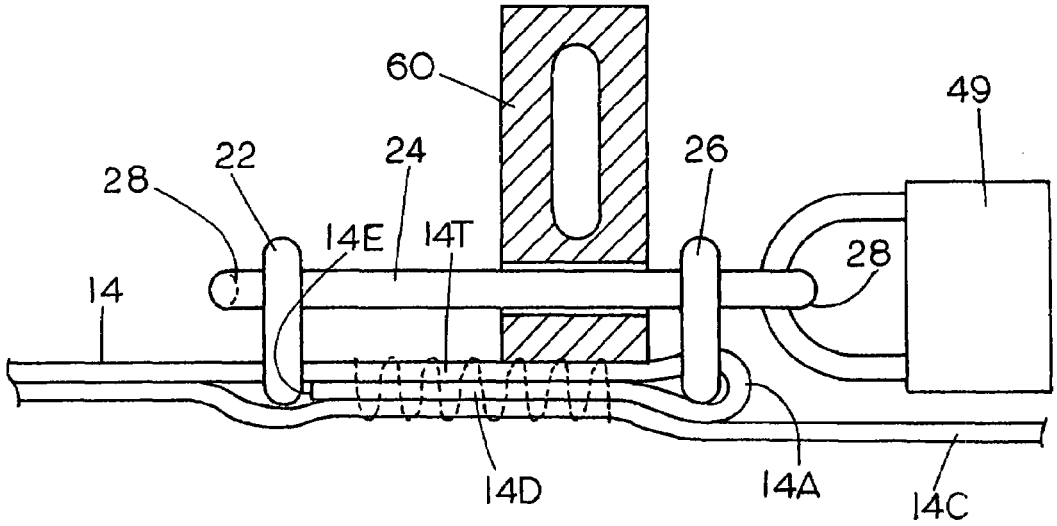
FIG. 5 is a side view of an elongated retainer link mount schematically showing a holder or box for mounting the handcuffs called a "blue box", shown in place.

Between the stitching at the neck loop and the stitching for the retainer ring 22 the two lengths of the strap are unattached so a body encircling chest band can be passed between the lengths, as will be shown. Ring 22 is permanently attached to an elongated link 24 that is held in the ring 22. The link 24 is a closed race track elongated link and is welded closed. After forming, the link 24 has one free end and can be slid along the ring 22. A second ring 26, which is perhaps best seen in FIG. 4, is held in an end loop of the strap 14 with sewing, and it is spaced from ring 22 a distance less than the length of the elongated link 24. The ring 26 is of size so that it will receive the end portion 28 of the race track or elongated link 24, and leave the closed end 28 of the link extending out from the ring 26 so that a padlock can be passed through the opening at the end 28 of the link 24, as shown perhaps best in FIG. 5 illustratively. The elongated link 24 can be slid on ring 22 and the rings 22 and 26 can be tilted for manipulation when securing end portion 28 through ring 26.

The race track or elongated link 24 is thus held spaced from the surface of the strap, chains, belts, handcuff chains and the like can be passed through the openings in the link 24. Also, the link 24 is insertable through an individual link of restraint chains. When it is locked into place at the end 28, the padlock hasp passes through the end portion 28 of the elongated link 24 which is then secured in place by the rings 22 and 26 on the restraint strap or harness 14.

Figure 6:
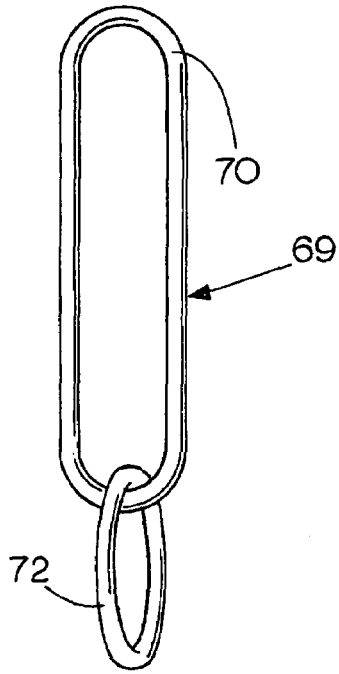
FIG. 6 is a front view of a completely enclosed quick link for locking various items with a permanently attached ring thereon.

As shown in FIG. 4, one end of the continuous strap is folded at end portion 14A around the ring 26, and as perhaps best seen in FIG. 6, a portion 14D is placed between two lengths of strap 14 and the end surface 14E of the 1 inch wide strap is in place to abut against ring 22 when the ring is sewn in place. The end portion 14D is between a top length 14T and the bottom length 14C, and the three thicknesses of strap are sewn together.

Figure 2:
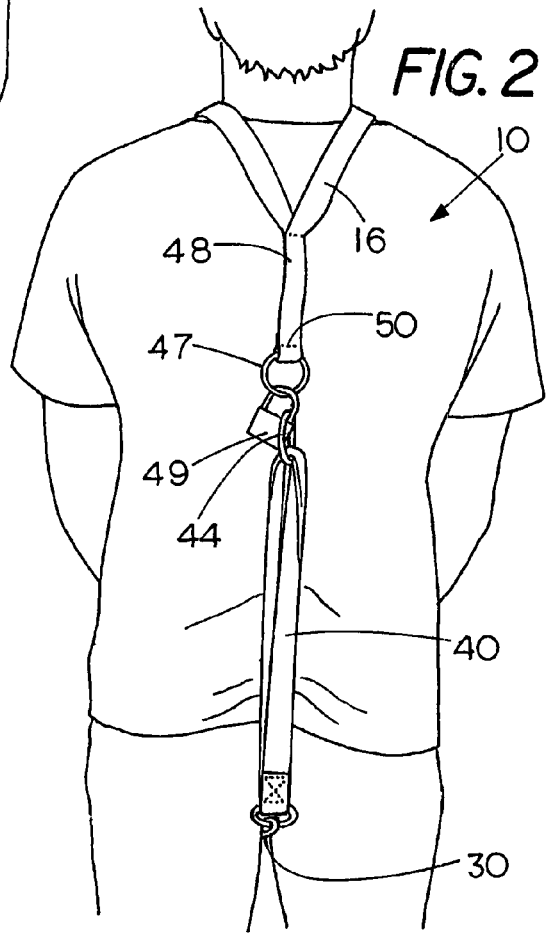
FIG. 2 is a rear view of the prisoner restraint strap installed on a user.

The strap length 14C forms an extension beyond the ring 26, and is of sufficient length so that it will pass underneath the crotch of the wearer, and toward the back. This is shown in FIGS. 2 and 4, where a tie ring 30 is held in a loop 32 of the web strap material 32. The strap 14 is made adjustable in length by passing through two rings 34 and 36 and held by doubling back, over one ring and under the other, much like a chin strap on a motorcycle helmet.

The strap end portions loop 32 of the strap length 14C thus loops around the ring 30, and through the double rings 34 and 36 so that ring 30 is inside the loop 32. The end 38 of the strap length 14C is also in the loop 32 and is folded and sewed to secure the rings 34 and 30 in place. The ring 30 holds a back strap or flexible elongated member 40, which is looped through the ring 30 and doubled upon itself and sewed together as at 42. The other end the back strap 40 has a ring 44 that is sewn in place in a loop of the strap 40 as shown at 46, at a suitable length. As can see in FIG. 2, when the restraint strap is in place on a person, the ring 44 is secured to a ring 47 that is sewn into the rear strap end 50 extending from a rear junction 48 at the rear of the neck loop 16. The rings 47 and 44 can be held together with a padlock or lock member 49 so that the restraint strap system is held securely. The lock member 49 is not accessible to the prisoner.

The elongated link 24, as can be seen is of size so that a handcuff chain shown at 54 can pass through the link opening, and this link and the handcuff chain can also be held together with a padlock, which is shown at 49 (FIG. 2). Additionally, if a belly chain or band is desired, the belly chain can be passed through link 24, and held in place with the same padlock which is also shown partially in FIG. 1 at 49.

A connector chain or strap can be extended down from the link 24 to leg irons or chains if desired, and held in place with a separate padlock or with the same padlock.

FIG. 5 shows a padlock box 60 that is of convention design, and one form of such box is shown in U.S. Pat. No. 6,000,249. The box 60 is a prior art device, and a through opening in the box is large enough to receive the free end of the elongated link 24 before the link was locked in place with the outwardly extending end portion 28 of the link 24 held in the ring 26 by the padlock 49.

Figure 3:
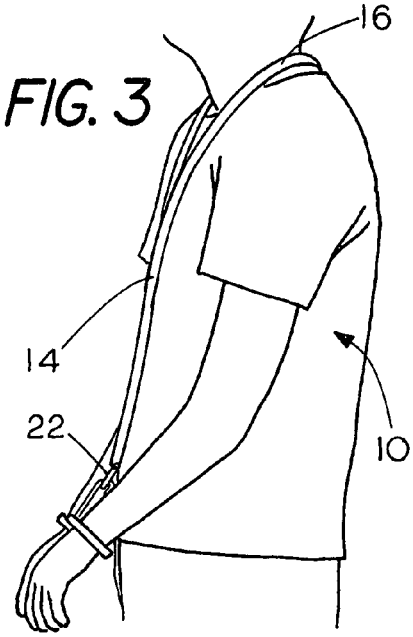
FIG. 3 is a side view of a user with the prisoner restraint strap in place.

When the restraint strap system is installed, as shown in FIGS. 1, 2 and 3, an adjustment for length can be made at rings 34 and 36. The length adjustments rings are at the crotch of the prisoner in use, so the length adjustment is inaccessible to the person wearing the strap restraint system. When the prisoner sits down the amount of slack in the front portion of the strap 14 is kept at a minimum. The elongated link 24 permits a wide variety of accessories to be fastened in place, and securing handcuffs to the front or frontal vertical strap, that loops over the head, prevents picking the junction padlock 49 which is positioned in the middle of the back and holds rings 44 and 47 together.

By adding a connector chain to leg irons or chains and a belly chain or band, and securing them to the elongated link 24, complete security can be achieved and the escape likelihood is substantially nil.

FIG. 6 illustrates a quick link assembly 69, which as shown has an elongated race track-like open center link 70, that is completely enclosed with a stop ring 72 thereon. Ring 72 is a continuous ring that slides along the link 70, to any position. The stop ring 72 is in the range of 1¼ inches in diameter, and would slide freely on the elongated link 70. The elongated link 70 thus can be inserted through the opening of link 24, and used for receiving a belly chain, or leg iron chains, and then that can be held in place with a suitable padlock. The stop ring 72 prevents the link 70 from sliding all the way through the link 24. The link 70 is of size so that it can pass through a chain link of a belly chain, or if desired the belly chain can pass through the link 70 and then the link can be locked into place.

When an end of the link 70 is inserted through one of the rings on the restraint assembly, for example, if it is inserted through the ring 26, the stop ring 72 prevents the link 70 from passing all the way through the ring 26, and forms a stop so that the link 70 can be extended out from the ring in which it is inserted and the extending end portion of the link used for holding accessories for restraining the prisoner. The accessories on the outwardly extending end can be locked in place with a padlock through the outer end of the link.

The completely enclosed, elongated link 70, in one form (but not the only form) would have an opening approximately 3 inches in length on the inside and 9/16 inches wide. This size will fit through a number of standard law enforcement restraint rings, links of chains, as well as holding a handcuff box. The link 70 can be used in a wide variety of ways for securing chains, belts handcuffs and other restraints.

The adjustment for length of the restraint strap can be by splicing or securing a length of chain to one end of the restraint strap so the adjustment can be one chain link at a time. Also a separate control strap 40A shown in FIG. 2 can be left unattached or locked on as desired.

Hook and loop fasteners (sold under the Trademark VELCRO) can be used in certain locations if desired as well.

A prisoner restraint comprising a transport system of a second embodiment is shown in FIGS. 7-10, and includes adjusting the length of the restraint strap by using a length of chain in place of a back strap 40, to provide for adjustment and also for additional security.

Figure 7:
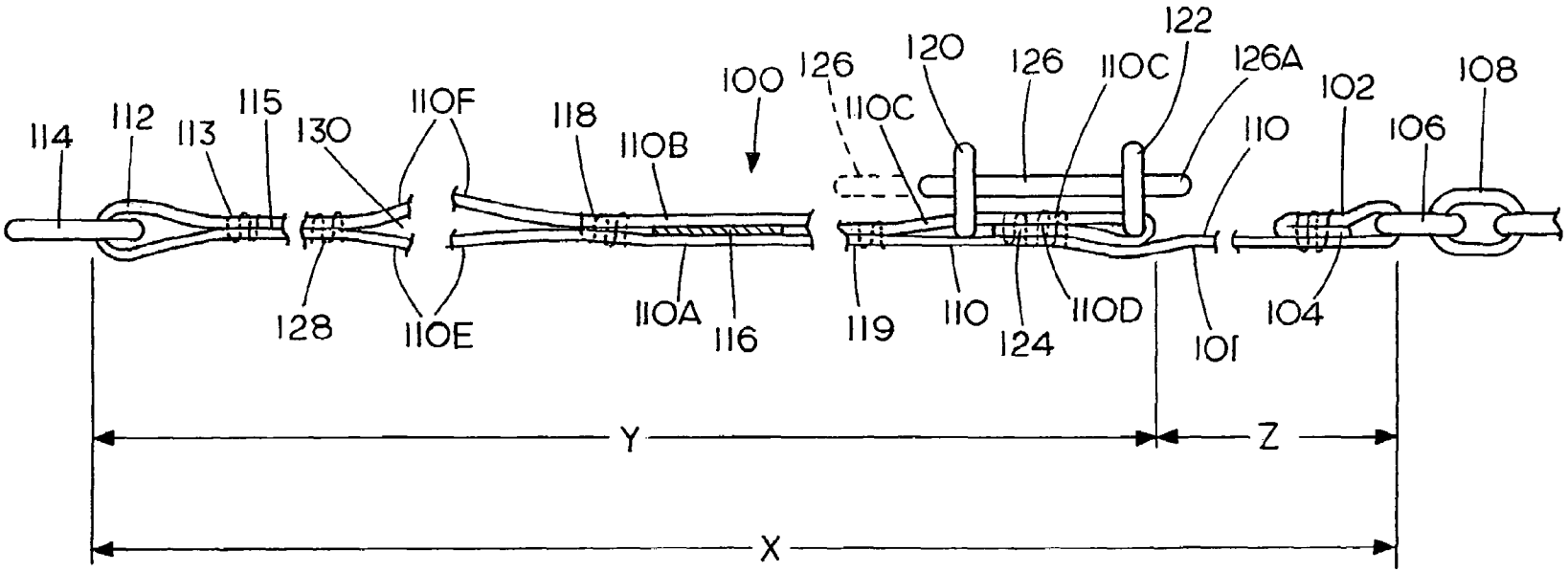
FIG. 7 is a side schematic, fragmentary layout of a restraint strap system of a second form of the present disclosure, using a back chain at the lower end thereof.

In FIG. 7, a flat layout of the restraint strap system or assembly is shown at 100. This comprises a single continuous strap 101 of approximately one-inch wide, suitable strong fabric, such as nylon, as previously explained. Starting at one end, which is adjacent the crotch when installed, there is a loop 102. It can be seen that an end portion 104 is folded under a short strap portion that is formed in loop 102 around a link 106 of a back chain assembly 108, which is a standard chain. After being looped around link 106 the strap 101 has a continuous length 110, that extends from the crotch end portion to a loop 112 for an upper back ring 114. The upper back ring 114 will be at the rear of the neck of a wearer. The strap 101 is looped around the back ring 114, and extends back toward end portion 104 and forms a back strap 115. The strap 115 is stitched securely as at 113 to form the loop 112.

Figure 8:
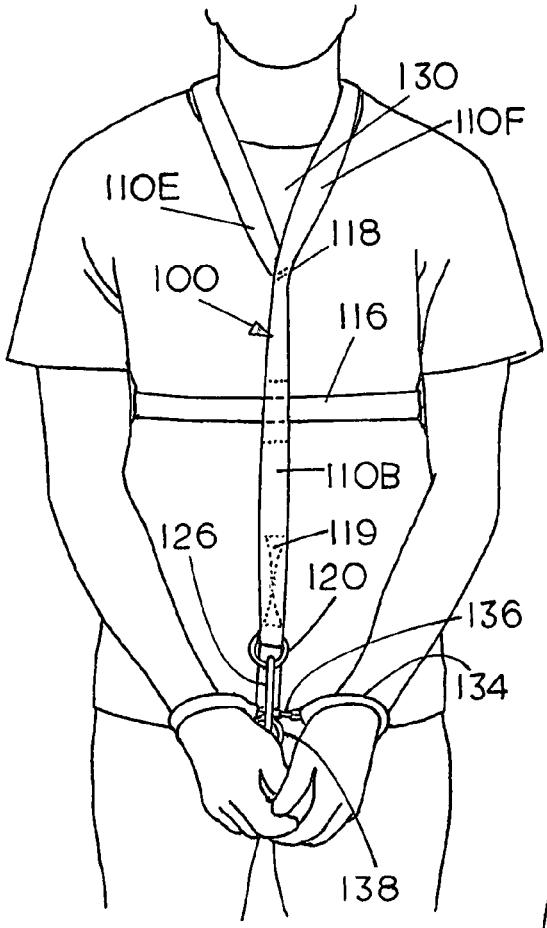
FIG. 8 is a front view of a person having the restraint system of the second form installed thereon.

The double strap layer back strap 115 is then formed (see FIG. 9) and ends at stitching 128. Strap sections 110E and 110F are left unstitched to form a neck loop 130 (FIGS. 8 and 9) at a top end of the back strap 115 and the neck loop passes to the front of the wearer, where it ends at stitching 118. A lower strap section 110A and an upper strap section 110B are unstitched and can be spaced apart to permit a cross chest band or body band 116 to be inserted between the two strap sections 110A and 110B. The strap sections 110A and 110B are then stitched together farther down the chest of the wearer as shown at 119 (FIG. 8).

A strap section 110C is raised up from lower length 110 at the end of the stitching 119 and a permanently attached retainer ring 120 and an elongated link 126, which is permanently looped on the ring 120 is placed between the strap section 110C and the lower length 110 in that region. Then strap section 110C as looped around a second spaced retainer ring 122 and an end section 110D is then placed underneath the strap section 110C and stitching 124 extends through the three layers of strap material comprising the lower length 110, the strap section 110C and strap section 110D. This secures the rings 120 and 122 in position so the rings are spaced longitudinally apart a selected distance. Again, it can be seen that a single strap 101 is used for the entire restraint strap system or assembly, and is doubled back on itself to form the back strap, neck loop, body band passage or loop, and loop retainers for the rings used.

In this form of the restraint system the chain 108 is provided for extending up the back of the wearer and for adjustment. Chain section 108 is shown only partially in FIG. 7, but, as shown in FIG. 9, it is made to have sufficient length so that it would go up around the back of the wearer or prisoner to loop around back ring 115 and provide adequate adjustment for locking in place with a quick attach elongated ring 70.

Elongated link 126 is a race track type link as shown, similar to or identical with link 70, and it is of length so that it can be extended through the ring 122 (it is not permanently attached to the ring 122) to provide end portion 126A on an outer side of ring 122 through which a padlock, or chain links or other securing devices can be passed.

Figure 9:
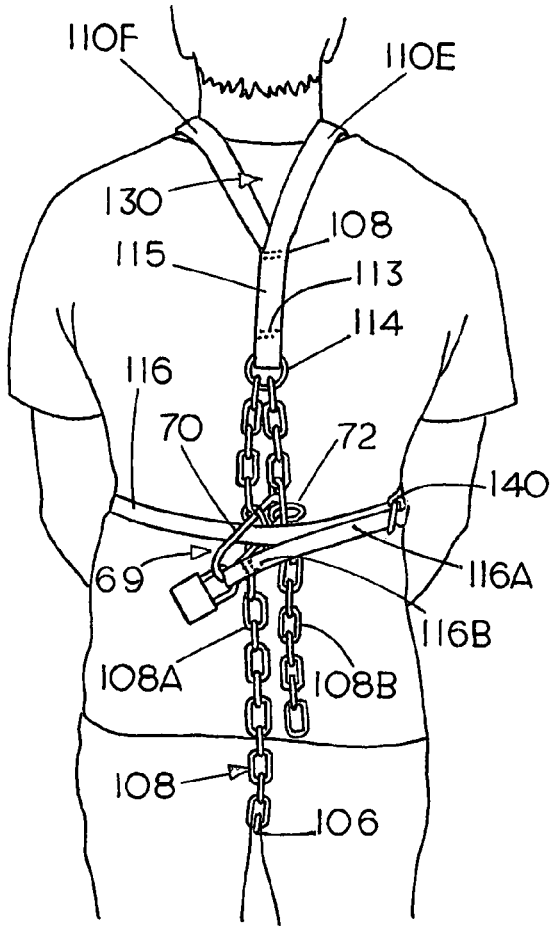
FIG. 9 is a back view of a person shown in FIG. 8 with the second form of the restraint system installed.

In FIG. 9 the back strap 115 is shown ending at stitching 128, which permits strap sections 110E and 110F to be separated to form a neck loop 130, which extends from the back of the wearer to the front of the wearer as shown in FIG. 8, and is stitched as at 118 to form the neck loop. The strap sections 110A and 110B are then separated at a location below the stitching 118, to form an opening through which a body band 116 may be passed, as shown in FIG. 8.

In FIG. 8, the secured ring 120 which is shown in place and the elongated link 126 are illustrated retaining handcuffs 134 on the wearer, with the handcuff chain 136 passing through the elongated link 126, and then the end portion of 126A of the link is passed through ring 122 and is secured with a padlock 138. The link 126 is held by and extends between the rings 120 and 122. The link 126 can be slid along the ring 120, as shown in dotted lines in FIG. 7.

FIG. 9, the back view, illustrates the end ring 106 is just at the rear of the crotch of the wearer, and the chain 108 extends upwardly, including an upwardly extending length 108A of a plurality of links that are of course permanently secured together, and then the chain is passed through the ring 114 that is held with the strap 115 at the back of the neck loop 130.

Figure 10:
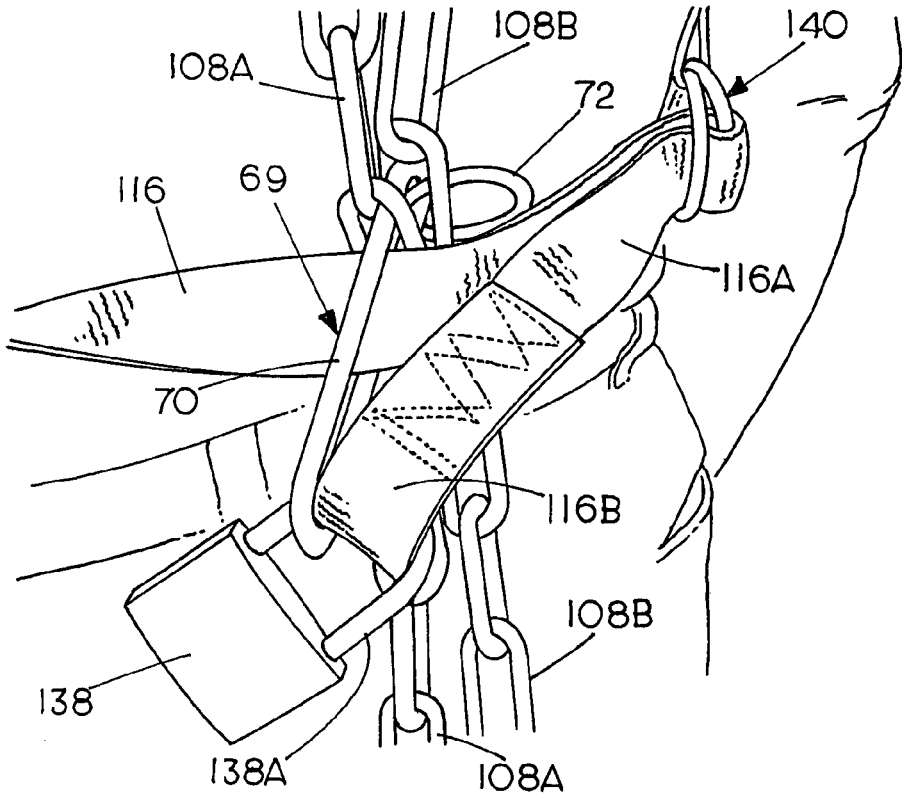
FIG. 10 is an enlarged view of the locking portions of the restraint system shown in FIG. 9.

The chain 108, after passing through the ring 114, has a length 108B that extends downwardly. The chain length is only illustrated generally, but it is cinched up so that the length 108A is fairly snug, and then the elongated link assembly 69, which is made specifically of size so that it will pass through the links of the chain 108, is used for securing the body band 116, and the two of chain lengths 108A and 108B, together with a padlock 138, which is the same construction as the padlock shown in FIG. 8. When securing the restraint strap system, the race track or elongated link 70 is passed through links of both of the chain lengths 108A and 108B, with one link of each of the lengths 108A and 108B having the ring 70 pass through it. The body band 116 is also passed through the opening of the link 70, as shown in FIGS. 9 and 10. The body band is secured around the body of the wearer with a pair of locking rings 140, which are secured to one end of the body band and operated like a helmet strap, by looping the free end 116A of the body band in through the rings 140, and passing the free end of the body band back over one ring and under the other so that the free end 116A extends out of the locking rings 140. An open loop 116B is formed at the end of the free end of the body band and the padlock hasp 138A of the padlock 138, as shown in FIG. 10 passes through the end of the elongated race track link 70 and through the loop 116B and locked in place.

Again, it should be noted that the ring 72 secured to the link 70 is used as a stop so that the elongated link 70 can be inserted through links of the chain lengths 108B and 108A and will be retained in place by the padlock. The ring 72 is a securely enclosed, non-separable ring, as is the race track link 70.

With the body band 116 secured in place, and the chain 108 adjusted for snugness, the prisoner or person being restrained is not able to bend over and loosen the straps sufficiently to pass a leg through or disengage the restraint system in any way.

The elongated quick attach link assembly 69 again is used advantageously for securing the chain lengths and body band or belt 116, and then always has a free end to which a hasp 138A of a padlock 138 can be passed for securing parts together.

Figure 11:
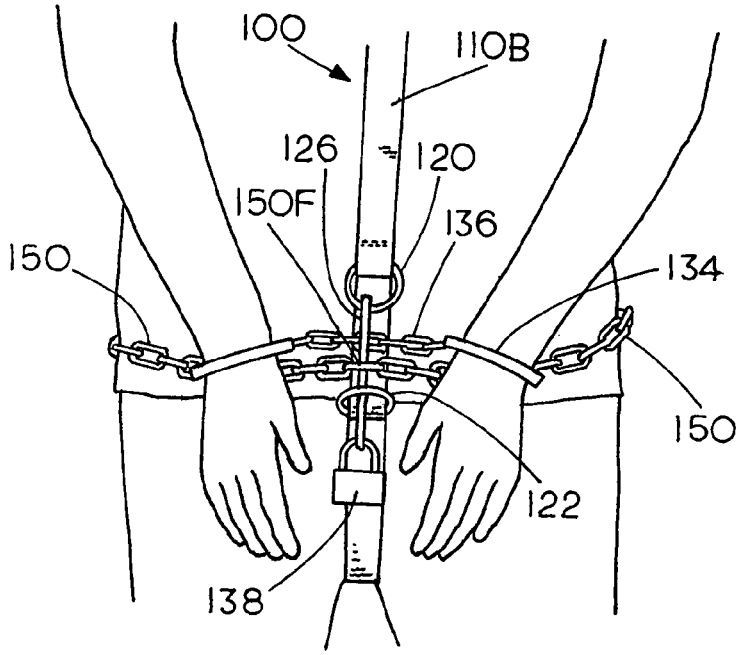
FIG. 11 is a front view similar to FIG. 8, with a different type of a body encircling band or member in place.

FIG. 11 shows a version of restraint using the restraint strap system 100, as shown in FIGS. 7, 8 and 9, where a different type of a body encircling band or restraint. In the showing in FIG. 11, the body band 116 has been replaced with a chain body band 150, commonly called a belly chain, that is passed under the arms of a user (the handcuffs, the rings and other parts of the same as that shown in FIG. 8), and body band or belly chain 150 is passed through the elongated link 126. The free end of link 126 can be passed through a link 150F of chain 150 and then through the ring 122 so that the padlock 138 can secure the end of the link 126. The band or chain 150 also could be passed through the open center of the elongated link 126. The chain 150 then is placed around the body of the wearer of the restraint system to the back of the wearer. The elongated link 126 securely holds both the hand cuffs 134 and chain 150 in place on the restraint strap system.

Figure 12:
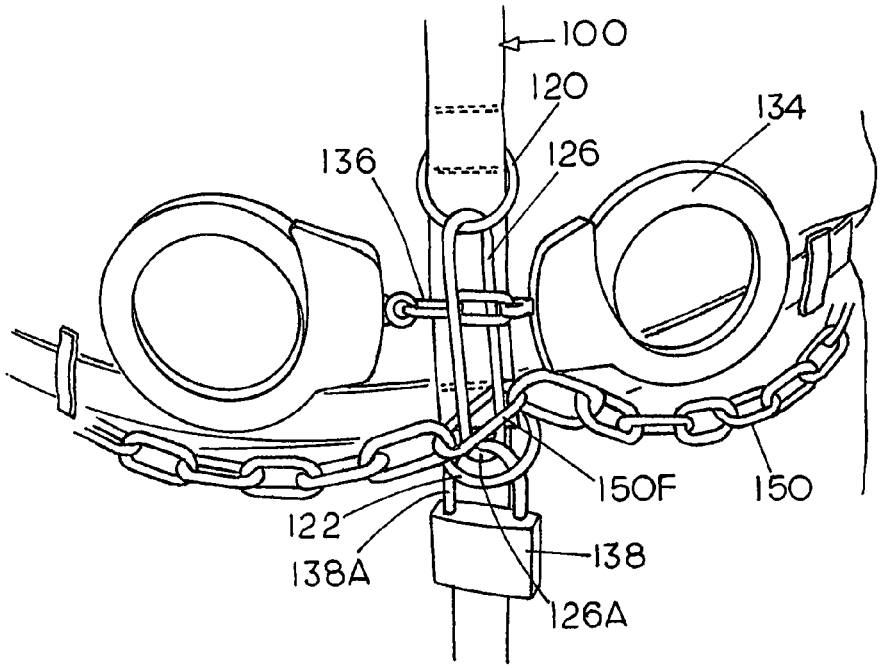
FIG. 12 is an enlarged schematic view of devices for securing of handcuffs in place in the system shown in FIG. 11.

FIG. 12 is an enlarged view of the arrangement shown in FIG. 11, with the handcuffs illustrated without the arms of the user in place. FIG. 12 illustrates the link 126 extending through link 150F of chain 150.

It can be again seen that the rings 120 and 122 secure elongated link 126 in place and the padlock on the end portion 126A and the handcuff chain 136 are illustrated more clearly. The body band or belly chain 150, as can be seen has the link 126 passing through an individual link 150F of the belly chain for additional security, and this link 150F is between the rings 120 and 122.

Figure 13:
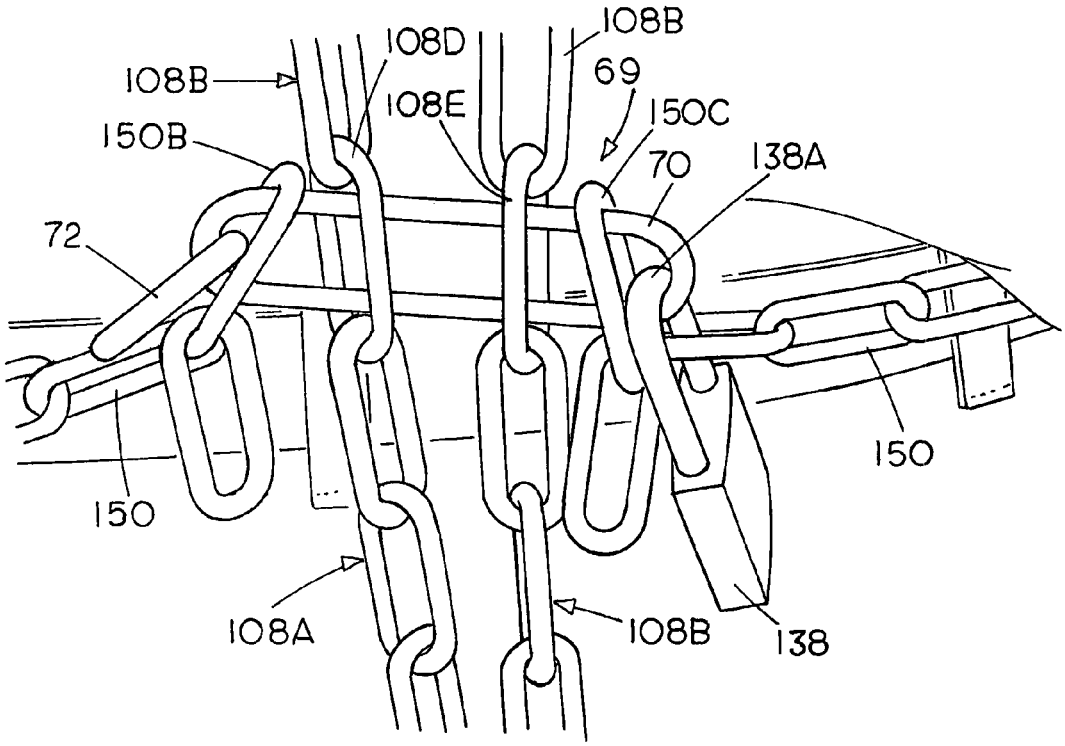
FIG. 13 is an enlarged view of the securing device for a belly chain at the rear of a person.

FIG. 13 illustrates the back arrangement for securing the body band or belly chain to the adjustable back chain 108 of the strap system. The chain lengths 108A and 108B are shown as separated, so the connections are more clearly shown. The quick attach link assembly 69, has the elongated link 70 passing through an individual link 150B of the body band or belly chain, then through an individual link 108D of the chain length or section 108A, through an individual link 108E of the chain length or section 108B, through a second individual link 150C of the opposite end portion of the body band or belly chain 150, and then the hasp 138A is passed through the end portion of the link 70 that protrudes beyond the link 150C of the body band or belly chain and is locked in place with the padlock 138.

The belly chain can be adjusted in length by leaving a greater end length loose, before securing the belly chain in place with the quick attach elongated link 70, which again forms a good tool for security because it can pass through individual links of the back chain 108 and the belly chain 150 and quickly secure the chains in place. The ring 72 will stop the link 70 from passing all the way through the other chain links.

Figure 14:
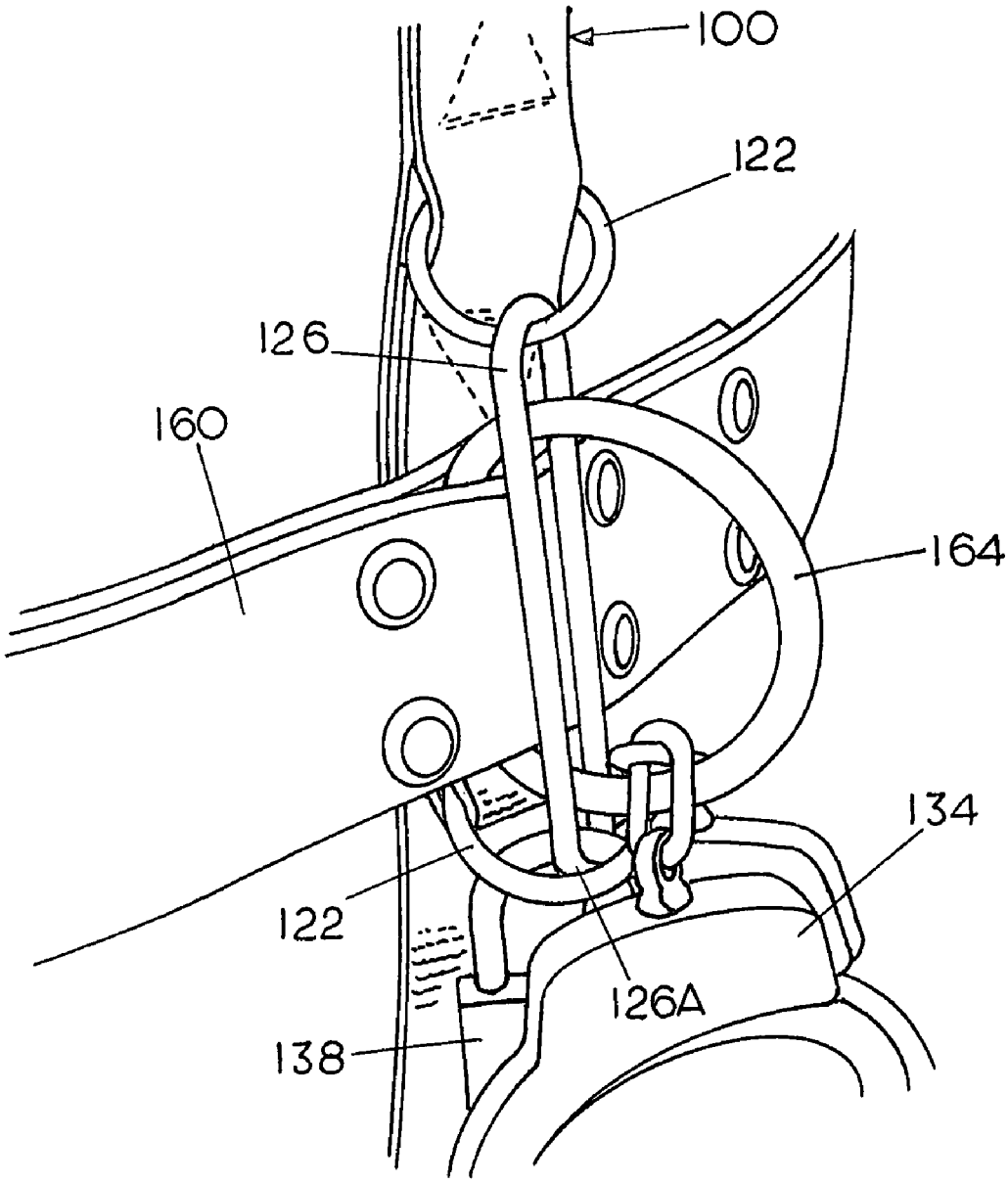
FIG. 14 is fragmentary front view of a typical conventional body belt being secured into the restraint strap system of the second form of the disclosure.
Figure 15:
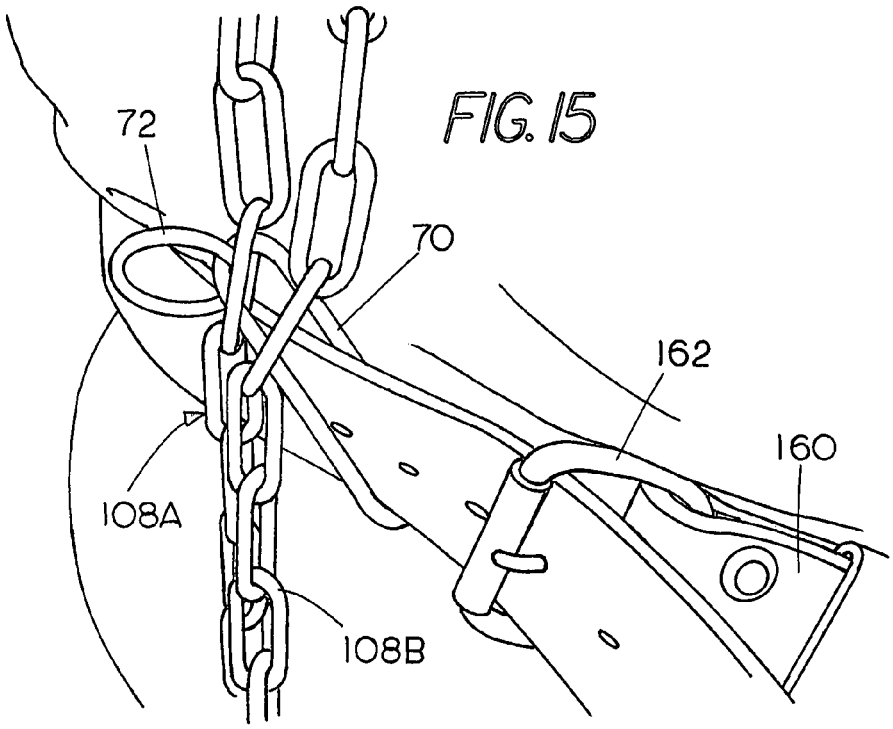
FIG. 15 is a rear view of a body belt being secured to the back chain of the second form of the restraint strap system.

The transport system can also be used with a conventional leather body band, commonly called a belly belt that is used at the present time around the waist of a prisoner or other person to be restrained, and which is then used for securing handcuffs in place. FIGS. 14 and 15 illustrate a conventional body band or belly belt 160, that can be buckled in place as shown in FIG. 15 where they buckle 162 is at the back of the person to be restrained, and which has a permanently affixed quite large ring 164 at the front side. It can be seen that the leather belt 160 has a strap that secures this ring in place. The strap is held in place securely with large rivets or other fasteners. The elongated link 126 is of size so that ring 164 will pass through the elongated ring 126 that is secured to the ring 120 on the restraint strap system 100.

The outer end portion of the ring 164 goes all the way through the elongated link 126 and fits between the ring 120 and the ring 122 on the frontal section of the strap system as shown at the lower portion of FIG. 14.

The padlock 138 can then be secured to the end portion 126A of the link 126 that extends out through the ring 122, as previously shown. In FIG. 14, handcuffs 134 are merely shown in place within the permanent ring 164 of the body belt, for illustrative purposes, but of course they would be secured to the wrists of the person being held by the restraint strap system 100.

FIG. 15 illustrates the rear view of the use of the body band or belt 160, and as mentioned the buckle 162 is placed at the rear. In this case, the chain lengths 108A and 108B are illustrated again, and the quick attach link assembly 69 is in place with the race track link 70 passing through individual links of the chain sections 108A and 108B, and held by the end ring 72. The quick attach link 70 is of size so that the belt 160 will pass through this link and the belt can be buckled with the buckle 162. There is no need for a padlock at the back, because of the locking together of the belt 160, the link 70, and the chain links from the chain lengths 108A and 108B.

Figure 16:
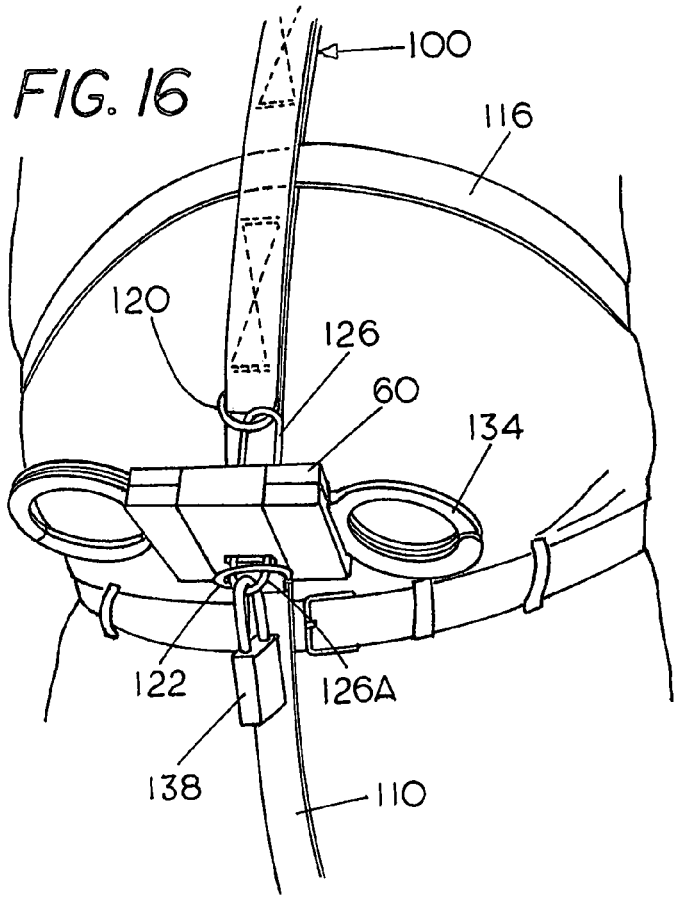
FIG. 16 is a front view schematically showing the attachment of a handcuff box to the strap system of the second form of the disclosure.

FIG. 16 is an illustration using the system 100 with a cuffbox of conventional design such as that illustrated in FIG. 5. In this form, the cuffbox 60, with handcuffs 134 in place is shown, with the link 126 passing through the opening in the cuffbox, such as that opening shown in FIG. 5, and then with the end portion 126A of the link 126 extends through the ring 122 and is held in place with a hasp 138A of a padlock 138, to secure the cuffbox and the handcuffs in place.

The strap portion 110 is illustrated in FIG. 16, and passes under the crotch of the wearer, so that the ring 106 is at the rear of the wearer as illustrated in FIG. 9. The body band 116 is also illustrated in FIG. 16, and can be put into place in any of the combinations.

The elongated links, and the rings placed in the restraint strap system are stainless steel and welded so that they are continuous and not openable. The chains such as that shown at 108, as well as the belly chain 150 can be standard welded link chains, generally of a size as a number 2 elongated link chain. The rings are usually 6 or 7 gauge stainless wire welded closed, and with parallel sides for the elongated quick attach link assembly 69 and the links 24 and 124. The elongated links 24, 70 and 126 are generally made of a size that would be approximately 3 inches long of the interior of the opening, with an interior opening width of about 9/16 of an inch, which would accommodate the size of the back and belly chain being used. The overall outside length of the links 24, 70 and 126 would then be about 3⅜ inches. The continuous strap formed as shown in FIG. 7, by way of example only, would have a length approximately 54 inches at the dimension X, in FIG. 7. The dimension Y, from the end of the loop 112 to the end where the ring 122 is fastened is in the range of 38 inches, while dimension Z would be in the range of 16 inches. The back chain 108 could be approximately 40 inches long, and it would accommodate a range of persons that would be transported. The length of the single length 101 of web material for forming the strap system 100 would be approximately 100 inches. Preferably it would be bright orange or some very visible color.

The quick connect link assembly 69 also can be used for providing a gang of prisoners or persons to be restrained along a chain by passing elongated links 70 through spaced links of a common gang chain that would be strung from prisoner to prisoner and having the handcuffs of each person held by one quick attach elongated link 70 to secure them in position, with the spacings selected by the person doing transport.

The present strap system can be worn under clothing, to be mostly concealed. It would be unobtrusive when transporting prisoners, for example by air. The elongated links used also can provide some movement of the hands for eating in a seated position if necessary.

The strap system shown in the first form of the invention, for example in FIG. 4 with the back strap 40 is usable for transporting persons that may be mentally challenged, where one could not let them wander off, while the system using the back chain for adjustment is primarily usable for prisoners that might attempt escape. A very secure transport system is thus provided.

Although the present invention has been described with reference to preferred embodiments, workers skilled in the art will recognize that changes may be made in form and detail without departing from the spirit and scope of the invention.

What is claimed is:

1. A personal restraint strap system comprising a strap having a neck opening, a frontal strap section, and a back section, a first connector at a back side of the neck opening, an opposite end of the frontal strap section from the back side of the neck opening having a second lower connector, a flexible, elongated back member attached to the second lower connector, and extending to be joined to the first connector at the back side of the neck opening, the frontal strap section having an elongated link secured thereto at one end and having a free end, a second ring on the frontal strap section spaced from the secured end of the elongated link and being positioned and of size to permit the elongated link to pass through the second ring, the elongated link being of size to receive at least one additional restraint device, an end portion of the elongated link extending through the second ring for permitting securing the elongated link with a lock to prevent the elongated link from being removed from the second ring.

2. The strap system of claim 1 wherein the first connector at the back side of the neck opening comprises a back strap, the back strap having a free end with a third connector thereon, and the back member being of length to pass between legs of a wearer of the restraint strap system and being connectable to the third connector.

3. The strap system of claim 1 wherein the flexible elongated back member comprises a back chain having a plurality of closed links attached to the second connector, and of length to pass between legs of a wearer and to be secured to the first connector, the first connector comprising a first connector ring, said chain passing through the first connector ring and forming adjacent chain portions, and a second elongated link having a first end of size to pass through a separate chain link of each of the chain portions, the second elongated link having a stop at a second end to prevent the second end of the second elongated link from passing through the chain links of the chain portions, the first end portion of the second elongated link extending from both separate chain links of the chain portions and being of size to extend beyond the separate links to receive a lock to retain the second elongated link in both of the separate links of the chain portions.

4. The strap system of claim 3 wherein the stop comprises a stop ring permanently secured to the second elongated link and of size to prevent the stop ring from passing through the separate links of the chain portions.

5. A personal restraint strap system comprising a strap having a neck opening, a frontal strap section, and a back section, a first connector at a back side of the neck opening, an opposite end of the frontal strap section from the back side of the neck opening having a second lower connector, a flexible, elongated back member attached to the second lower connector, and extending to be joined to the first connector at the backside of the neck opening, the frontal strap section having an elongated link secured thereto at one end and having a free end, a second ring on the frontal strap section spaced from the secured end of the elongated link and being positioned and of size to permit the elongated link to pass through the second ring, an interior opening of the elongated link being of size to receive at least a handcuff chain, an end portion of the elongated link extending through the second ring for permitting securing the elongated link with a pad lock to prevent the end portion of the elongated link from being removed from the second ring.

6. The strap system of claim 5 wherein the first connector at the back side of the neck opening comprises a back strap, the back strap having a free end with a third connector thereon, the and the back member being of length to pass between legs of a wearer of the restraint strap system and being connectable to the third connector.

7. The strap system of claim 6 wherein the frontal strap section comprises a length adjustment, the back member comprising a lower back strap section with a fourth connector ring at a free end thereof, the third connector comprising a ring, the fourth connector ring and the third connector ring being connectable with a padlock.

8. The strap system of claim 6 wherein the flexible elongated back member comprises a back chain having a plurality of closed links attached to the second connector, and of length to pass between legs of a wearer and to be secured to the first connector, the first connector comprising a first connector ring, said chain passing through the first connector ring and forming adjacent chain portions, and a second elongated link having a first end of size to pass through a separate chain link of each of the chain portions, the second elongated link having a stop at a second end to prevent the second end of the second elongated link from passing through the chain links of the chain portions, the first end portion of the second elongated link extending from both separate chain links of the chain portions and being of size to extend beyond the separate links to receive a lock to retain the second elongated link in both of the separate links of the chain portions.

9. The strap system of claim 8 wherein the stop comprises a stop ring permanently secured to the second elongated link and of size to prevent the stop ring from passing through the separate links of the chain portions.

10. A restraint system having a restraint strap for a person and having a plurality of connectors, each connector consisting of one of a separate enclosed link and a separate link of a chain, and an attachment link comprising an elongated enclosed link member having spaced sides and ends forming a central elongated opening, an enclosed link ring permanently secured on the elongated enclosed link member and being slidable around the entire elongated enclosed link member, the elongated enclosed link member sides being spaced so the elongated enclosed link member will pass through the connectors, the enclosed link ring being of a size to prevent the enclosed link ring from passing through the connectors to form a stop.

11. The restraint system of claim 10 wherein the elongated enclosed link member has a length to have an end portion extending outwardly from one or more connectors through which the elongated enclosed link is passed for providing a link portion to receive a lock.

* * * * *